US008091648B2

(12) United States Patent
Allen

(10) Patent No.: US 8,091,648 B2
(45) Date of Patent: Jan. 10, 2012

(54) DIRECT CONNECTING DOWNHOLE CONTROL SYSTEM

(75) Inventor: Robert Steven Allen, Bossier City, LA (US)

(73) Assignee: T-3 Property Holdings, Inc., Houston, TX (US)

( * ) Notice: Subject to any disclaimer, the term of this patent is extended or adjusted under 35 U.S.C. 154(b) by 0 days.

(21) Appl. No.: 12/913,954

(22) Filed: Oct. 28, 2010

(65) Prior Publication Data

US 2011/0036595 A1 Feb. 17, 2011

Related U.S. Application Data

(63) Continuation of application No. 11/941,179, filed on Nov. 16, 2007, now Pat. No. 7,845,415.

(60) Provisional application No. 60/867,476, filed on Nov. 28, 2006.

(51) Int. Cl.
*E21B 23/00* (2006.01)
*E21B 33/04* (2006.01)

(52) U.S. Cl. ..... 166/382; 166/86.1

(58) Field of Classification Search ..... 285/123.1, 285/123.2, 123.5, 123.12; 166/90.1, 305.1, 166/279, 88.4, 75.13, 75.14, 375, 343, 368
See application file for complete search history.

(56) References Cited

U.S. PATENT DOCUMENTS

| | | | | |
|---|---|---|---|---|
| 1,944,481 | A | 1/1934 | Wells | |
| 3,431,965 | A | 3/1969 | Tillman, III | |
| 3,884,298 | A | 5/1975 | Watkins | |
| 3,885,629 | A | 5/1975 | Erb | |
| 3,950,021 | A | 4/1976 | Goldschild et al. | |
| 4,023,620 | A | 5/1977 | Gazda et al. | |
| 4,067,388 | A | 1/1978 | Mouret et al. | |
| 4,121,660 | A | 10/1978 | Koleilat | |
| 4,143,712 | A | 3/1979 | James et al. | |
| 4,247,135 | A | 1/1981 | Weirich et al. | |
| 4,406,303 | A * | 9/1983 | Kilmoyer | 137/554 |

(Continued)

FOREIGN PATENT DOCUMENTS

EP 0 378 040 A1 7/1990

(Continued)

OTHER PUBLICATIONS

Weatherford, DDV™: From Emerging to Established, Weatherford magazine, Feb. 2007, pp. 12-14, vol. 9 No. 1 (4 pages).

(Continued)

*Primary Examiner* — Thomas Beach
*Assistant Examiner* — James Sayre
(74) *Attorney, Agent, or Firm* — Strasburger & Price, LLP

(57) ABSTRACT

A system and method are provided for direct connecting downhole control hydraulics through an oil field hanger, where the hanger is coupled to a wellhead, to hydraulic lines extending outside the wellhead. Further, the direct connection allows hydraulic system integrity with reduced contamination and leakage. Hydraulic tool ports, formed on the hanger, are coupled with hydraulic lines extending downward to a hydraulic tool. Side ports, formed in the hanger, are fluidicly coupled to the hydraulic tool ports. Hydraulic lines extending outside the wellhead are directly coupled with the side ports by accessing the side ports through access openings in the wellhead when the ports are aligned with the access openings. The system can still maintain pressure within internal spaces of the wellhead after the connection by sealing the access openings with flanges, where the hydraulic lines extend through openings in the flanges that are also sealed around the lines.

20 Claims, 7 Drawing Sheets

U.S. PATENT DOCUMENTS 4,458,903 A 7/1984 Tohill
4,471,965 A 9/1984 Jennings et al.
4,552,213 A 11/1985 Boyd et al.
4,568,062 A 2/1986 Regitz et al.
4,623,020 A * 11/1986 Nichols ..... 166/88.4
4,659,530 A 4/1987 Boyers et al.
4,819,967 A 4/1989 Calder et al.
4,848,457 A 7/1989 Lilley
4,848,777 A 7/1989 Zollo et al.
4,896,722 A 1/1990 Upchurch
4,928,769 A 5/1990 Milberger et al.
5,031,695 A 7/1991 Cain et al.
5,044,442 A 9/1991 Nobileau
5,109,923 A 5/1992 Koleilat
5,339,912 A 8/1994 Hosie et al.
5,456,321 A 10/1995 Shiach et al.
5,465,794 A 11/1995 McConaughy et al.
5,474,124 A 12/1995 Samuels et al.
5,503,230 A 4/1996 Osborne et al.
5,555,935 A 9/1996 Brammer et al.
5,662,181 A 9/1997 Williams et al.
5,730,218 A 3/1998 Swagerty et al.
5,732,772 A 3/1998 Borak, Jr. et al.
5,755,287 A 5/1998 Cain et al.
5,775,422 A 7/1998 Wong et al.
5,775,427 A 7/1998 Skeels et al.
5,782,297 A 7/1998 Samuels et al.
5,791,657 A 8/1998 Cain et al.
5,865,250 A 2/1999 Gariepy
5,896,925 A 4/1999 Swagerty et al.
5,988,282 A 11/1999 Jennings et al.
5,996,695 A 12/1999 Koleilat et al.
6,015,009 A 1/2000 Allen
6,050,339 A 4/2000 Milberger
6,062,314 A * 5/2000 Nobileau ..... 166/368
6,065,536 A 5/2000 Gudmestad et al.
6,076,605 A 6/2000 Lilley et al.
6,112,810 A 9/2000 Bailey et al.
6,119,773 A 9/2000 Gariepy et al.
6,152,232 A 11/2000 Webb et al.
6,186,239 B1 2/2001 Monjure et al.
6,209,663 B1 4/2001 Hosie
6,244,348 B1 6/2001 Gariepy et al.
6,253,854 B1 7/2001 Fenton
6,263,982 B1 7/2001 Hannegan et al.
6,302,212 B1 10/2001 Nobileau
6,343,658 B2 2/2002 Webb
6,401,747 B1 6/2002 Cain et al.
6,401,827 B1 6/2002 Ferguson et al.
6,408,945 B1 6/2002 Telfer
6,457,529 B2 10/2002 Calder et al.
6,470,965 B1 10/2002 Winzer
6,470,971 B1 10/2002 Bridges
6,470,975 B1 10/2002 Bourgoyne et al.
6,474,412 B2 11/2002 Hamilton et al.
6,484,807 B2 11/2002 Allen
6,510,895 B1 1/2003 Koleilat et al.
6,516,876 B1 2/2003 Jennings
6,520,207 B2 2/2003 Bartlett et al.
6,581,691 B1 6/2003 Jennings et al.
6,615,915 B2 9/2003 Koleilat
6,719,044 B2 4/2004 Ford et al.
6,719,059 B2 4/2004 Dezen et al.
6,732,804 B2 5/2004 Hosie et al.
6,763,891 B2 7/2004 Humphrey et al.
6,840,323 B2 1/2005 Fenton et al.
6,918,574 B2 7/2005 Hallden et al.
6,923,423 B2 8/2005 Jones et al.
6,942,028 B2 9/2005 Hosie
6,968,902 B2 11/2005 Fenton et al.
6,974,341 B2 12/2005 Jennings
6,978,839 B2 12/2005 Fenton et al.
7,032,673 B2 4/2006 Dezen et al.
7,086,481 B2 8/2006 Hosie et al.
7,121,344 B2 10/2006 Fenton et al.
7,121,349 B2 10/2006 Jennings
7,178,600 B2 2/2007 Luke et al.
7,204,315 B2 4/2007 Pia et al.
7,219,729 B2 5/2007 Bostick et al.
7,219,741 B2 5/2007 Fenton et al.
7,237,623 B2 7/2007 Hannegan
7,240,736 B2 7/2007 Fenton et al.
7,255,173 B2 8/2007 Hosie et al.
7,318,480 B2 1/2008 Hosie et al.
7,350,590 B2 4/2008 Hosie et al.
7,413,018 B2 8/2008 Hosie et al.
7,445,046 B2 11/2008 Borak, Jr.
7,451,809 B2 11/2008 Noske et al.
7,475,732 B2 1/2009 Hosie et al.
7,647,973 B2 1/2010 Minassian et al.
7,650,943 B2 1/2010 Baggs
7,686,342 B2 3/2010 Jennings et al.
7,740,074 B2 6/2010 White et al.
7,845,415 B2 12/2010 Allen
2004/0079532 A1 * 4/2004 Allen et al. ..... 166/379
2005/0242519 A1 11/2005 Koleilat et al.
2007/0246220 A1 10/2007 Fenton
2007/0284113 A1 12/2007 Haheim
2008/0060846 A1 3/2008 Belcher et al.
2008/0121400 A1 5/2008 Allen
2008/0245531 A1 10/2008 Noske et al.
2009/0000781 A1 1/2009 Bolding
2009/0032241 A1 2/2009 Allen et al.

FOREIGN PATENT DOCUMENTS

EP 1 322 833 B1 7/2003
MX 284500 5/2008
WO WO 03/067017 A2 8/2003
WO WO 2004/044367 A2 5/2004
WO WO 2004/044368 A2 5/2004
WO WO 2005/040545 A2 5/2005
WO WO 2005/056980 A1 6/2005
WO WO 2006/059223 A2 6/2006
WO WO 2007/116264 A1 10/2007

OTHER PUBLICATIONS

Wood Group Pressure Control website, Control Line Exit Block, Down Hole Control Valve (DHCV) Exit Assembly, printed Feb. 26, 2008, Technical Bulletin #05-0097, corresponding website http://portal.woodgroup.com (3 pages).

Wood Group Pressure Control website, Time-Saving Wellhead SH3 Speedhead System, printed Feb. 26, 2008, Technical Bulletin #04-0395,corresponding website http://portal.woodgroup.com (4 pages).

Wood Group Pressure Control website, Time-Saving Wellhead, LSH Land Speedhead System, printed Feb. 26, 2008, Technical Bulletin #05-0143, corresponding website http://portal.woodgroup.com (4 pages).

Wood Group Pressure Control website, Tubing Head, MTH2 Mini Tubing Head, printed Feb. 26, 2008, Technical Bulletin #04-0397, corresponding website http://portal.woodgroup.com (3 pages).

Wood Group Pressure Control website, Time-Saving Wellhead, Multi-Well Completion, MWC System, printed Feb. 26, 2008, Technical Bulletin #05-0177, corresponding website http://portal.woodgroup.com (3 pages).

Wood Group Pressure Control website, Time-Saving Wellhead, SH2 Split Speedhead System, printed Feb. 26, 2008, Technical Bulletin #04-0394, corresponding website http://portal.woodgroup.com (4 pages).

Wood Group Pressure Control website, Time-Saving Wellhead, OSH Offshore Speedhead System, printed Feb. 26, 2008, Technical Bulletin #04-0396, corresponding website http://portal.woodgroup.com (4 pages).

Vetco Gray website, Close Proximity Wellhead Systems, printed Feb. 27, 2008, corresponding website http://www.vetcogray.com/products/surfacewellhead/Pages/CloseProximityWellhead.aspx, © General Electric Company 1997-2007 (1 page).

Vetco Gray website, Conventional Tubing Hanger Systems, printed Feb. 27, 2008, corresponding website http://www.vetcogray.com/products/surfacewellhead/Pages/Conventional Tubing Hangars.aspx, © General Electric Company 1997-2007 (2 pages).

Vetco Gray website, Multibowl Wellhead Systems, printed Feb. 27, 2008, corresponding website http://www.vetcogray.com/products/ surfacewellhead/Pages/MultibowlWellhead.aspx, © General Electric Company 1997-2007 (1 page).
Vetco Gray website, Non-Welded Casing Seal Wellhead Connector, printed Feb. 27, 2008, corresponding website http://www.vetcogray.com/products/surfacewellhead/Pages/Non-WeldedCasingSealWellheadConnector.aspx, © General Electric Company 1997-2007 (1 page).
Vetco Gray website, NT-2 Connectors, printed Feb. 27, 2008, corresponding website http://www.vetcogray.com/products/surfacewellhead/Pages/NT-2Connectors.aspx, © General Electric Company 1997-2007 (2 pages).
Vetco Gray website, Casing Seal Systems, printed Feb. 27, 2008, corresponding website http://www.vetcogray.com/products/surfacewellhead/Pages/CasingSealSystems.aspx, © General Electric Company 1997-2007 (2 pages).
T3® Energy Services website, TimeSaver Wellhead system™ , printed Feb. 20, 2008, corresponding website http://www.t3energy.com/well/ (1 page).
Weatherford, DDV™ Downhole Deployment Valve, Brochure 335.05, © 2005-2007 Weatherford (4 pages).
Weatherford, Real Results, Successful Trial of Downhole Deployment Valve (DDV™) Proves the Validity of DDV Technology, © 2003-2007 Weatherford (1 page).
U.S. Patent and Trademark Office, Interview Summary, U.S. Appl. No. 10/281,055, see previously cited US2004/0079532 A1, Applicant(s) Allen et al., Jan. 7, 2005 (1 Page).
U.S. Patent and Trademark Office, Notice of Abandoment, U.S. Appl. No. 10/281,055, see previously cited US2004/0079532 A1, Applicant(s) Allen et al., January 11, 2005 (2 pages).
U.S. Patent and Trademark Office, Office Action Summary, U.S. Appl. No. 10/281,055, see previously cited US2004/0079532 A1, Applicant(s) Allen et al., Jun. 7, 2004 (11 pages).
T3® Energy Services, 2007 Management Presentation, T3® Energy Services Products, *see* Through-Bore Diverter System (TDS), Dec. 2007 (10 pages).
Weatherford, Liner Hanger Selection, A Guide for Drilling and Completion Engineers, 1st ed. May 2006, © 2006 Weatherford (24 pages).
Nodeco, A Weatherford Company, Liner Hanger Systems, Brochure No. 95.00, 1997, Weatherford/Lamb, Inc. (24 pages).
United Wellhead Services, Inc., UWS Products and Services Catalog, 2001 (24 pages).
Joy Petroleum Equipment, Larkin Well Heads, Catalog No. 60-77, © 1977 Joy Manufacturing Company (12 pages).
Weatherford® , Multilaterals No Longer Impossible From Floating Rigs, © 1999 Weatherford (1 page).
Williams Tool Company Inc., Riser Cap, 1999 (1 page).
Weatherford, Underbalanced Drilling Downhole Deployment Valve, Weatherford Underbalanced Systems, Jun. 21, 2002, © Weatherford International, Inc. (28 page).
Weatherford, Accessory Equipment, Weatherford Underbalanced Systems, Jun. 21, 2002, © Weatherford International, Inc. (also appears in "BB"above) (1 page).
GE Oil & Gas website, Multibowl Systems, printed May 7, 2008, corresponding website http://www.gepower.com/businesses/ge_oilandgas/en/prod_serv/systems/surface_drilling/m..., © General Electric Company 1997-2007, see reference "K"above (1 page).
Email dated Oct. 26, 2007, Title: DDV Wellhead System (3 pages).
T3 Energy Services Powerpoint presentation entitled Timely & Innovative Solutions (18 pages).
T3 Energy Services website, T-3 Thru Diverter System (TDS-1) Wellhead, printed May 5, 2009 (2 pages).

* cited by examiner

DIRECT CONNECTING DOWNHOLE CONTROL SYSTEM

CROSS REFERENCE TO RELATED APPLICATIONS

This application is a continuation of co-pending U.S. Non-Provisional application Ser. No. 11/941,179, filed on Nov. 16, 2007, which claims the benefit of U.S. Provisional Application No. 60/867,476, filed Nov. 28, 2006, both of which are hereby incorporated by reference for all purposes in their entirety.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX

Not applicable.

BACKGROUND

1. Field of the Invention

The invention relates to oil field tools. More specifically, the invention relates to oil field downhole tools and wellhead equipment.

2. Description of Related Art

Oil field wells are typically controlled by a "stack" of equipment for supporting downhole "strings" of tubulars, such as casing and tubing, valves, and other equipment to manage the drilling and production pressurized fluids in a well. An initial "surface" casing is placed in the open well-bore and a base plate is mounted thereto. A wellhead typically sits on top of the base plate to provide controlled access to the well-bore during drilling and production. Various spools, a tubing head, and valves can be assembled thereto. As the well-bore depth increases, additional smaller casings can be placed inside the surface casing to the deeper portions of the well. The additional casings are supported in the stack by supporting surfaces in the wellhead, a casing hanger held in the wellhead, or a casing spool mounted to the wellhead. When the well is completed at a certain depth and cement is placed around the outer surface of the casing, production tubing is installed to the desired production depth in a similar arrangement by supporting the tubing from a tubing hanger and coupling the tubing hanger from the wellhead. A blow out preventer is usually installed in the stack to control the well if an emergency overpressure condition occurs. In the past, the stack and particularly the blow out preventer were disassembled to place another size casing or tubing into the well-bore. The system needed to be pressure tested after each re-assembly, costing significant expense and time. Also, because the well-bore could have significant pressure during the interim access without the blowout preventer, the disassembly and reassembly was hazardous.

Over the last 100 years, the improvements in the drilling and production systems typically have been small, incremental adjustments to satisfy specific needs as deeper wells were drilled and produced sometimes with higher pressures, faster drilling, less disassembly and assembly, and other improvements. One improvement in recent years is a "unitized" head. The unitized wellhead facilitates using different sizes of casing and tubing without having to disassemble major portions of the stack or remove the blowout preventer. One such unitized wellhead is available from T3 Energy Services, Inc. of Houston, Tex., USA. The unitized wellhead includes a lower casing head and upper casing spool and is installed as a single unit. As smaller sizes of casing strings are needed, different casing hangers can be progressively cascaded and installed within the bore of the unitized wellhead for supporting the casing stings without removing the blowout preventer. When the casing is set and cemented in place, a support pack-off bushing can be installed above the casing hangers to seal the annulus below the casing hanger and the wellhead flanges, and create a landing shoulder for the tubing hanger. A tubing head can be installed above the unitized wellhead casing spool to house the tubing hanger.

Further, the method of counteracting downhole pressures in the drilling has improved. In the past, drilling has been accomplished by providing a drilling fluid "mud" to weigh down and counteract fluids in the well-bore sometimes with large upward pressures. The weighted mud is pumped downhole while drilling occurs, so that the well-bore pressure does not force well fluids to rise to the surface and cause difficult and hazardous conditions. However, using such mud increases costs and drilling time, and can counterproductively damage the hydrocarbon formation that is to be produced. Improvements have been made in drilling by reducing use of the mud through a technique sometimes referred to as "under-balanced drilling" and more appropriately "managed drilling." The drilling can proceed without the heavy mud and is typically faster with less down time. A "downhole deployment valve" is inserted down the well-bore as a type of one-way check valve attached to the casing to block the downhole well fluids under pressure from escaping up through the casing. The downhole deployment valve is typically set at a certain depth and remains at that depth while drilling continues to greater depths. The drill pipe, bit, and other drill assembly devices are inserted through the downhole deployment valve to drill the well-bore. The drill string can be removed back through the downhole deployment valve and the downhole deployment valve closes to seal the downhole fluids. When the drill bit is changed or the drill string is otherwise "tripped," the operation can be done easier and generally safer because the casing above the downhole deployment valve is vented to atmosphere. Hydraulic control lines from the surface wellhead allow the pressurization of hydraulic fluid downhole to the downhole deployment valve and are used to selectively control the operation of the downhole deployment valve.

While the downhole deployment valve provides improvements, there have been challenges with protecting the integrity of the hydraulic fluid controlling the downhole deployment valve. Typically, the hydraulic fluid passes through control lines external to the wellhead through a fluid port in the sidewall of the wellhead. The ports are open on the inside of the wellhead. During installation, the downhole deployment valve is typically coupled to a section of casing, a casing hanger is installed on the opposite end of the casing, and control lines are run from the downhole deployment valve up to hydraulic ports on the bottom of the casing hanger. The casing hanger hydraulic ports exit the casing hanger through the side of the casing hanger. The downhole deployment valve, casing, and casing hanger are lowered into the wellhead, until the casing sits on a shoulder of the wellhead. A series of annular seals disposed in annular zones of the casing head theoretically fluidicly seal the side ports of casing hanger with the ports in the sidewall of the wellhead, so that the hydraulic fluid is isolated from other portions of the well-bore and can pass to the respective ports. In practice, the seals leak due to the drilling fluids, sand and rock, and other debris and contaminants in the wellhead and well-bore from the drilling operations. The ports and hydraulic fluid can be contaminated and cause control issues with the downhole deployment valve. Such an example of sealing is illustrated in U.S. Pat. No. 4,623,020, incorporated by reference.

Further, the control lines can be compromised from external forces. Equipment can impact the control lines, operators can unintentionally and intentionally step on the control lines, and other physical damage can occur to the control lines that can render the system inoperative and potentially be hazardous to operators nearby.

Thus, there remains a need for improvements in the connection of hydraulics lines and related system to operate a downhole deployment valve and other downhole tools.

BRIEF SUMMARY

A system and method are provided for direct connecting downhole control hydraulics through an oil field hanger, where the hanger is coupled to a wellhead, to hydraulic lines extending outside the wellhead. Further, the direct connection allows hydraulic system integrity with reduced contamination and leakage. Hydraulic tool ports, formed on the hanger, are coupled with hydraulic lines extending downward to a hydraulic tool. Side ports, formed in the hanger, are fluidicly coupled to the hydraulic tool ports. Hydraulic lines extending outside the wellhead are directly coupled with the side ports by accessing the side ports through access openings in the wellhead when the ports are aligned with the access openings. The system can still maintain pressure within internal spaces of the wellhead after the connection by sealing the access openings with flanges, where the hydraulic lines extend through openings in the flanges that are also sealed around the lines.

The disclosure provides a wellhead system for coupling hydraulic lines to a downhole hydraulic tool, comprising: a hanger disposed in the head having at least one hydraulic tool port adapted to be coupled to the downhole hydraulic tool, and a hydraulic side port on a side of the hanger disposed at an angle to the tool port and fluidicly coupled to the tool port; and a drilling wellhead adapted to support the hanger, the head comprising: an access opening formed through a side of the head and aligned with the hydraulic side port on the hanger when the hanger is seated in the head; a flange coupled to the access opening and adapted to form a seal with the access opening, the flange having a sealable opening through which a hydraulic line can be inserted and connect directly with the hydraulic side port in the hanger when the side port is aligned with the access opening of the head.

The disclosure provides a method of providing hydraulic fluid to a downhole hydraulic tool, comprising: mounting a drilling wellhead to a well-bore, the drilling wellhead having an access opening formed in a side of the head and adapted to be coupled to a sealing flange, the flange having a flange opening fanned therethrough; coupling a downhole hydraulic tool to a tubular member; coupling the tubular member to a hanger, the hanger having a hydraulic side port in fluid connection with a hydraulic tool port; coupling a hydraulic line between the hydraulic tool and the hydraulic tool port on the hanger; inserting the hydraulic tool, the tubular member, and the hanger down the well-bore; seating the hanger in the drilling wellhead; aligning the side port in the hanger with the access opening in the drilling wellhead; directly coupling a hydraulic line to the side port in the hanger through the opening in the flange and the access opening in the head; and sealing the hydraulic line from ambient pressures outside the access opening in the head.

BRIEF DESCRIPTION OF THE DRAWINGS

While the concepts provided herein are susceptible to various modifications and alternative forms, only a few specific embodiments have been shown by way of example in the drawings and are described in detail below. The figures and detailed descriptions of these specific embodiments are not intended to limit the breadth or scope of the concepts or the appended claims in any manner. Rather, the figures and detailed written descriptions are provided to illustrate the concepts to a person of ordinary skill in the art as required by 35 USC §112.

DETAILED DESCRIPTION

One or more illustrative embodiments of the concepts disclosed herein are presented below. Not all features of an actual implementation are described or shown in this application for the sake of clarity. It is understood that the development of an actual embodiment, numerous implementation-specific decisions must be made to achieve the developer's goals, such as compliance with system-related, business-related and other constraints, which vary by implementation and from time to time. While a developer's efforts might be complex and time-consuming, such efforts would be, nevertheless, a routine undertaking for those of ordinary skill in the art having benefit of this disclosure.

Figure 1:
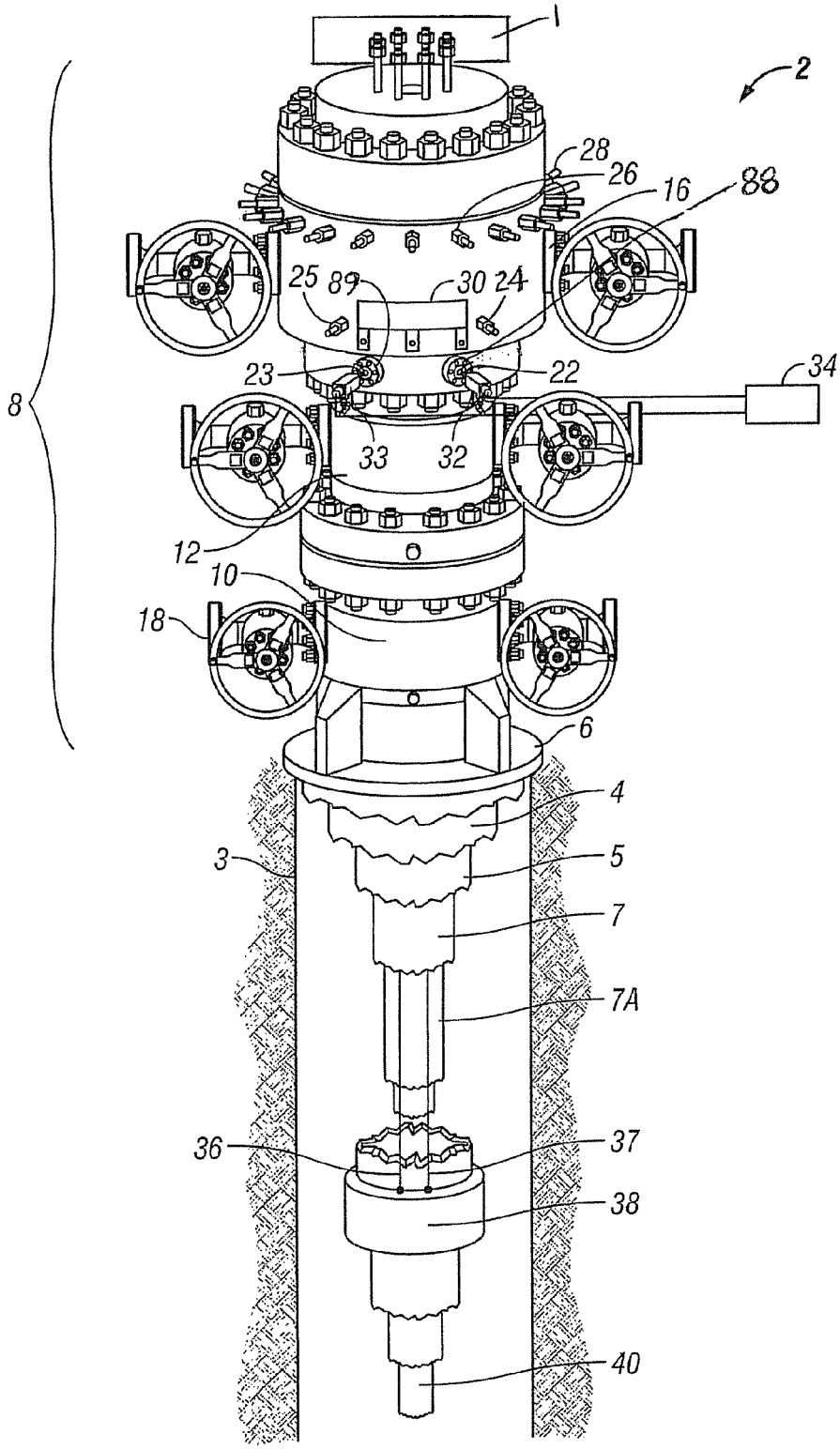
FIG. 1 is a schematic diagram of a wellhead system located above a well-bore having a direct connecting hydraulic line through a drilling wellhead to an internal hanger.

FIG. 1 is a schematic diagram of a wellhead system located above a well-bore having a direct connecting hydraulic line through a drilling wellhead to an internal hanger. The wellhead system 2 generally includes a drilling wellhead, a hanger, and other equipment as may be generally used in such systems, and further includes various openings and ports for directly connecting the hydraulic lines through the wellhead into the hanger, as detailed below. In at least one embodiment, the wellhead system 2 will generally be mounted above a well-bore 3. The well-bore has a surface casing 4 installed from the surface of the well-bore down to a certain depth. A base plate 6 is mounted to the surface casing and forms the foundation to which the other components are mounted that form the "stack" of wellhead equipment. The well-bore is drilled in successive steps with each step generally being a smaller diameter as the depth progresses. Thus, a casing 5 can be inserted inside the surface casing 4 with a smaller diameter to a given depth. Progressively smaller casings, such as casing 7 and casing 7A, can be further provided at still greater depths. The wellhead contains support structures, generally hangers, to support the suspended casing or casings. The wellhead 8 can include in at least one embodiment a casing head 10 and a casing spool 12. Such an arrangement is advantageous when using a unitized wellhead, such as commercially available from T3 Energy Services, mentioned above. A blowout preventer (BOP) 1, shown schematically, is mounted above the wellhead 8. A tubing head 16 is mounted above the wellhead 8 and generally above the blowout preventer if provided. The tubing head can support or at least surround a tubing hanger. The tubing hanger can support a suspended string of production tubing inside the one or more casings. Various valves, such as valve 18, pressure gauges, sensors, and other devices can be used in conjunction with the wellhead to provide onsite or remote control of the wellhead system.

More specific to the present invention, the wellhead can include at least one access opening 20 and in some embodiments a second access opening 21. A sealing member, such as sealing flange 88 can be coupled to the opening 20 and a corresponding sealing member, such as flange 89, can be coupled to the opening 21. The flanges can provide a pressure-type seal against internal pressures in the wellhead that may exceed 10,000 PSI. A hydraulic line 22 can pass through the opening 20 and generally through the sealing flange 88 to connect with the hanger. Similarly, a hydraulic line 23 can pass through its respective access opening 21 through the flange 89 to be coupled with the hanger. To facilitate alignment between the openings 20, 21 and the appropriate position of the internal hanger, an alignment pin 27, described below, can be disposed through the side wall of the wellhead to align the internal members, such as the hanger. Various leads, such as threaded pins, known as "leads" can support internal members as is customary in the industry. For example, support packoff leads 24, 25 can support a support packoff internal to the assembly that assists in isolating pressure from downhole fluids. Similarly, tubing hanger leads 26 can support the tubing hanger internal to the tubing head.

The system 2 can further include one or more test ports 28. The operator may wish to know prior to opening the openings 20, 21 whether the system is presently under pressure, or whether there is leakage in the system that would unintentionally place generally un-pressurized portions of the system in pressurized conditions. For further safety, one or more protector steps 30 can be disposed at least partially over or around the openings 20, 21 and the associated hydraulic lines to provide a support surface for personnel.

One or more hydraulic valves 32, 33 can be mounted to the hydraulic lines 22, 23. The hydraulic valves can control the flow of the hydraulic fluid between the subsurface downhole hydraulic tool and surface control equipment. A surface control unit 34 is generally coupled to the hydraulic control lines to either manually or automatically control a downhole hydraulic tool 38. The downhole hydraulic tool is hydraulically coupled by coupling the hydraulic lines 22, 23 in the wellhead with hydraulic lines 36, 37 disposed downhole to the downhole hydraulic tool 38. An exemplary downhole hydraulic tool 38 can be a downhole deployment valve. The downhole deployment valve provides a check valve to uphole flow of well-bore fluids and enhances the safety of the downhole operations. As described herein, the hydraulic lines 36, 37 can be coupled to a hanger such as the wellhead 8 and then coupled to the hydraulic lines 22, 23 without requiring the hydraulic annular seals to maintain hydraulic pressure, referenced above.

Once the drilling is accomplished, a string of production tubing 40 can be placed inside the well-bore through the wellhead system. It is generally supported by a tubing hanger. described below. The tubing hanger is generally disposed in a tubing head, but can be disposed in the casing head 10, the casing spool 12, and similar members coupled thereto.

Figure 2:
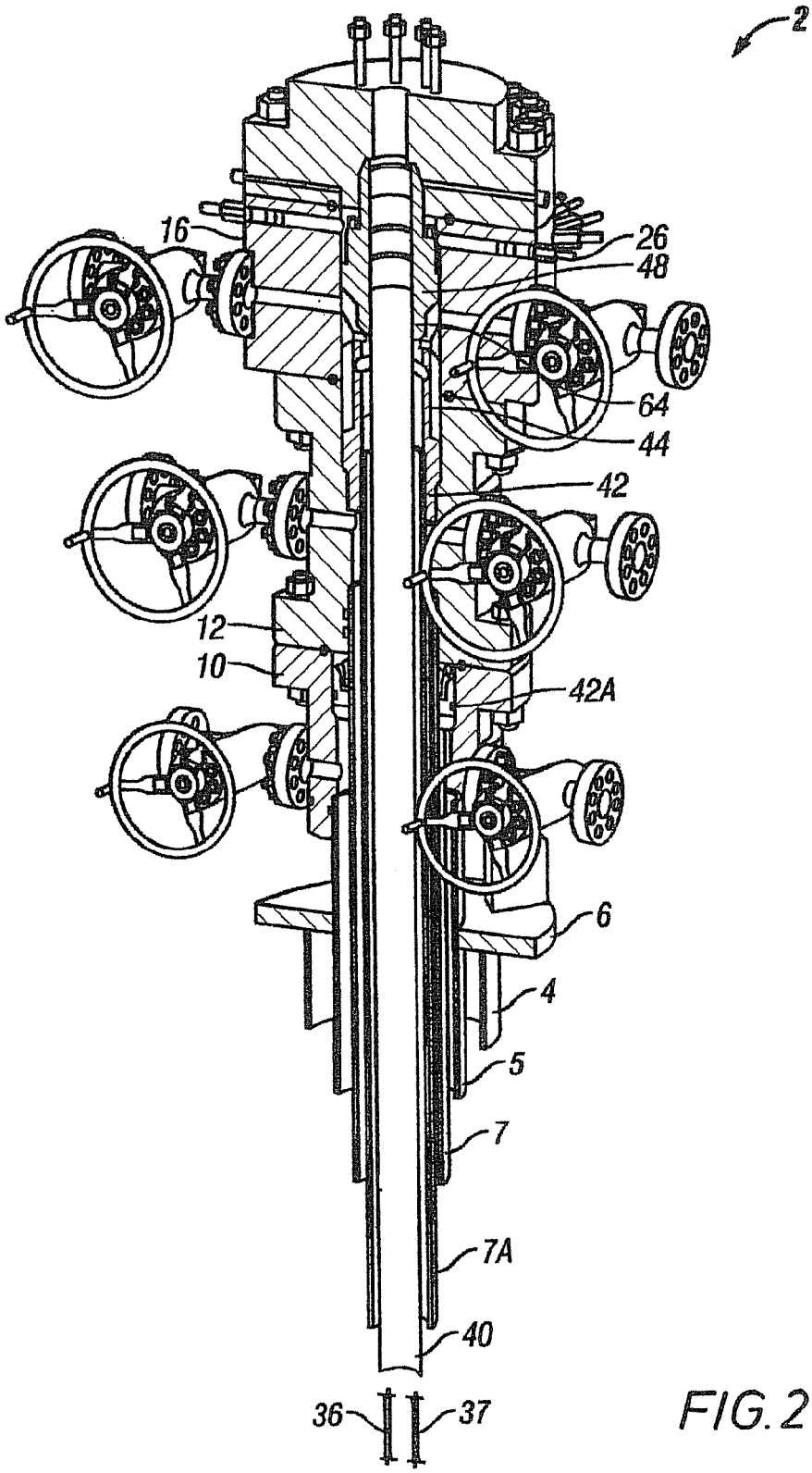
FIG. 2 is a cross-sectional schematic diagram of the wellhead system illustrating various hangers and tubular members.

FIG. 2 is a cross-sectional schematic diagram of the wellhead system illustrating various hangers and tubular members. The elements in FIG. 2 are similarly numbered as in FIG. 1 and have been described in reference thereto. More particularly, the casing head 10 can be coupled to the base plate 6, sometimes through an intermediate structure, and supports various tubular members therein. For example, the casing head 10 can support a casing 5 coupled to a lower surface of the casing head and one or more smaller casings 7, 7A coupled to one or more types of casing hangers 42, 42A. When the casings reach the desired depth, a support packoff 44 can be installed on top of the casing hanger 42 to seal well-bore pressures in the wellhead from below the support packoff A tubing hanger 48 can be disposed in the tubing head 16, or alternatively in the casing head 10 or the casing spool 12. The tubing hanger 48 can support the production tubing 40 through which the hydrocarbons of the well-bore can be produced into facilities external to the wellhead system 2. The hydraulic lines 36, 37 can be disposed downhole from the wellhead system 2 to connect to the hydraulic tool described in FIG. 1.

Figure 3:
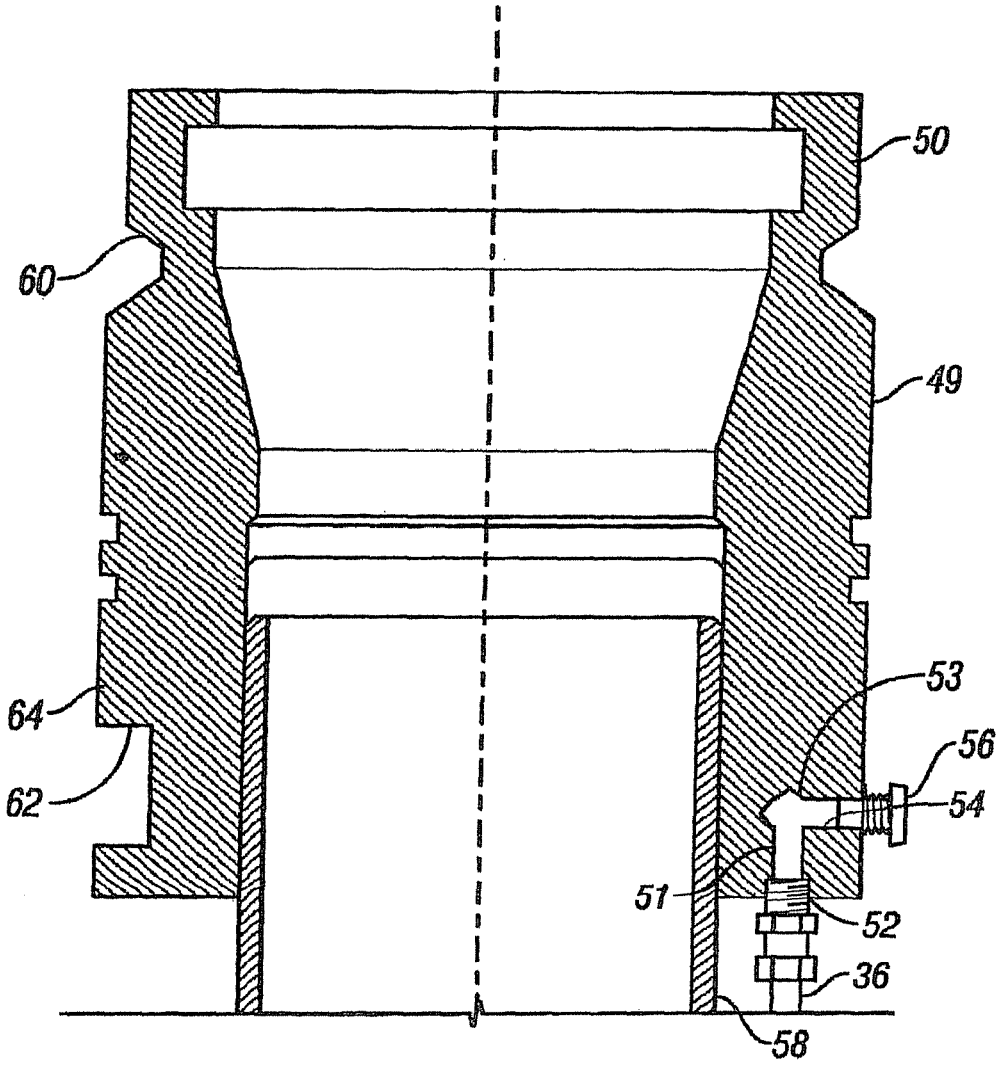
FIG. 3 is a cross-sectional schematic diagram of a hanger with a hydraulic tool port and a hydraulic side port.
Figure 3A:
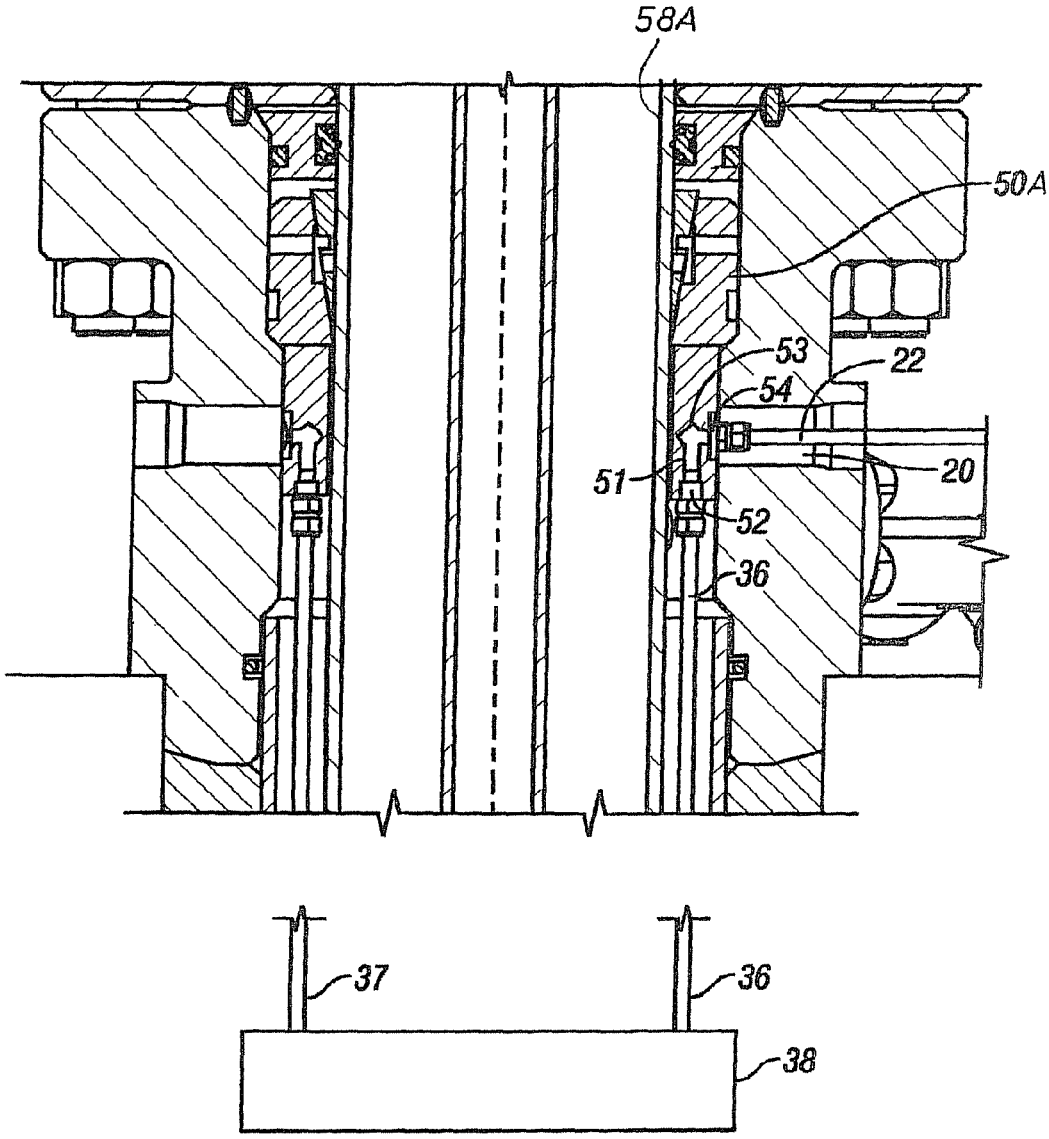
FIG. 3A is a cross-sectional schematic diagram of a hanger with a hydraulic tool port and a hydraulic side port coupled to a hydraulic line to a downhole hydraulic tool and a hydraulic line extending outward from the hanger through the wellhead.

FIG. 3 is a cross-sectional schematic diagram of a hanger 50 with a hydraulic tool port and a hydraulic side port. FIG. 3A is a cross-sectional schematic diagram of a slip hanger 50A with a hydraulic tool port 52 coupled to a hydraulic line 36 to a downhole hydraulic tool 38, and a hydraulic side port 54 coupled to a hydraulic line 22 extending outward from the hanger 50A through the wellhead. The figures will be described in conjunction with each other. A hanger can be any number of styles of hangers commonly used in the oilfield, including casing hanger, tubing hanger, slip hanger 50A (shown in FIG. 3A), fluted hanger, and other hangers as would be familiar to those with ordinary skill in the art. As shown in FIGS. 3 and 3A, tubulars 58, 58A may be coupled between hangers 50, 50A, respectively, and tool 38. The hanger includes at least one passageway 51 through which hydraulic fluid can flow through the hanger between the hydraulic lines 22 (shown in FIGS. 1, 3A, 5A, 6, 7), 23 (shown in FIGS. 1, 6, 7) at the wellhead and the hydraulic lines 36, 37 (see FIGS. 1, 2, 3, 3A, 5A) extending down to the downhole hydraulic tool 38. The passageway 51 provides a conduit to a side 49 (shown in FIG. 3) of the hanger 50. Because of the relative positions of the hydraulic lines mounted to the hanger and the hydraulic lines 22, 23 mounted to the hanger side 49, in at least some embodiments, it is possible that the passageway 51 can extend in a different direction to create a second passageway 53 in the side of the hanger 50 or hanger 50A. In other embodiments, the passageway 51, 53 could represent a single passageway, such as drilled at an angle to the hanger bottom and side so that both surfaces are intersected and the hydraulic lines can be mounted thereto. Where passageways 51, 53 exit the respective surfaces, ports are formed that can be coupled to fittings and other members of the hydraulic system. For example, a hydraulic tool port 52 can be formed on the passageway 51 and can be coupled to one or more couplings, or other fittings to support the connection of the hydraulic line 36 directly to the port 52.

Similarly, a hydraulic side port 54 is formed at the exit of passageway 53 in the side 49. Generally, the hydraulic tool port 52 will be located on the bottom surface of the hanger and the hydraulic side port 54 will be located on the side 49 of the hanger. Thus, generally, the ports will be disposed at an angle to each other. The one or more access openings to the hydraulic side ports are formed to the side of the head and aligned with the hydraulic side ports on the hanger when the hanger is seated in the head. The port 54 as described herein can be connected directly to a hydraulic line, such as the hydraulic line 22. By "direct", it is intended to include a fluid connection between a hydraulic line and a port that does not require the annular seals that are used to seal annular zones between the hanger and the internal surfaces of a wellhead, such as shown in U.S. Pat. No. 4,623,020 described above.

Advantageously, the system described herein allows the integrity of the hydraulic system to be protected during installation of the hanger 50 into the wellhead referenced above. For example, a plug 56 can be inserted into an open port, such as side port 54 to protect the hydraulic system from contaminants in the wellhead system caused by the well-bore fluids as the hanger is installed in the wellhead. The lower tool port 52 is protected by being sealingly coupled to the hydraulic line 36 which is in turn sealingly coupled to the downhole hydraulic tool 38, so that the well-bore fluids cannot enter therein. The plug 56 can be removed after the hanger 50 is set in place and aligned with the one or more openings as described below.

In some embodiments, the side port 54 can be disposed in a skirt 64 of the hanger 50. The skirt 64 is generally a reduced concentric portion of a hanger as is known to those with ordinary skill in the art. In some hangers, the skirt is situated below a shoulder of the hanger where the shoulder is sized to engage a corresponding landing on the drilling wellhead. An example of such a hanger and skirt is further shown in FIG. 2 of the hanger 42 but is also applicable on other hangers, such as slip hangers, tubing hangers, fluted hangers, and other types of hangers.

The hanger 50 can further include one or more recesses 60, 62 as would be known to those with ordinary skill in the art. The recesses can be used for supporting the hanger in the head with different leads, such as leads 24, 25, 26 as shown together in FIG. 1, leads 24, 25 as shown in FIG. 4, and lead 26 as shown in FIG. 2.

Figure 4:
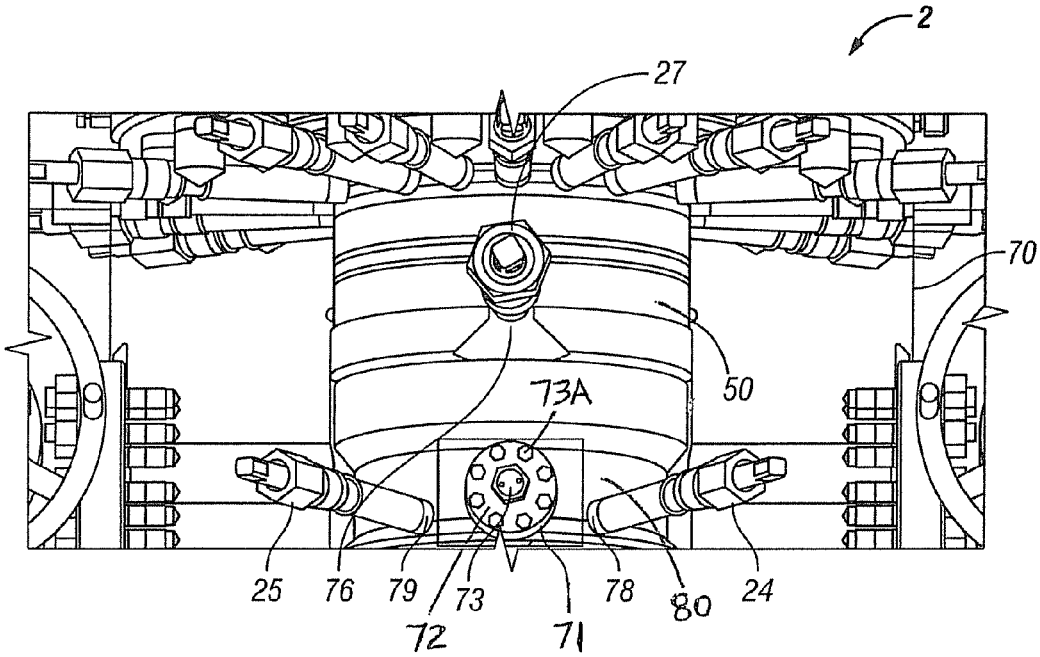
FIG. 4 is a partial cross-sectional schematic diagram of the wellhead system showing internal details, including one or more locating pins for aligning the hanger with the wellhead and access openings in the wellhead.

FIG. 4 is a partial cross-sectional schematic diagram of the wellhead system showing internal details, including one or more locating pins for aligning the hanger with the wellhead and access openings in the wellhead. The wellhead system 2 as described above generally includes the hanger 50 over support packoff 80 disposed internal to the drilling wellhead 70. The hanger 50 can be a number of different and various hangers adapted for the purposes described herein. Thus, the hanger can be used at various locations in the wellhead. Without limitation, therefore, the drilling wellhead 70 is broadly intended to include the various supporting portions of the wellhead described above, including the casing head, casing spool, tubing head and other similar structures as may be useful in supporting the hanger 50 in the wellhead system 2.

One feature of the present invention is the alignment of a hydraulic side port, such as the side port 54 in the hanger 50 shown in FIG. 3, with a respective access opening, such as the access opening 20 shown in FIG. 3A. The alignment allows the external hydraulic line 22, shown in FIG. 3A, to be directly coupled through the wellhead and its opening to the respective side port.

To facilitate such alignment, an alignment pin 27 can be provided in the drilling wellhead 70 to correspondingly mate with an alignment recess 76 (shown in FIGS. 4 & 5A) formed in the hanger 50. Thus, as the hanger 50 is seated in its proper position longitudinally in the drilling wellhead 70, the alignment pin 27 can further insure that the hanger is seated rotationally as well. Furthermore, one or more leads 24, 25 can be disposed through the drilling wellhead 70 to engage recesses 78, 79, respectively, if provided.

A flange 72 having a fitting 73 is generally coupled to an access opening 71. The access opening 71 can be used as a view port to visually determine the condition of members internal to the wellhead upon removal of flange 72. The flange 72 can be removably coupled, through various fasteners, such as a plurality of bolts similar to bolt 73A, to maintain the integrity of the system during pressurized operations.

Figure 5:
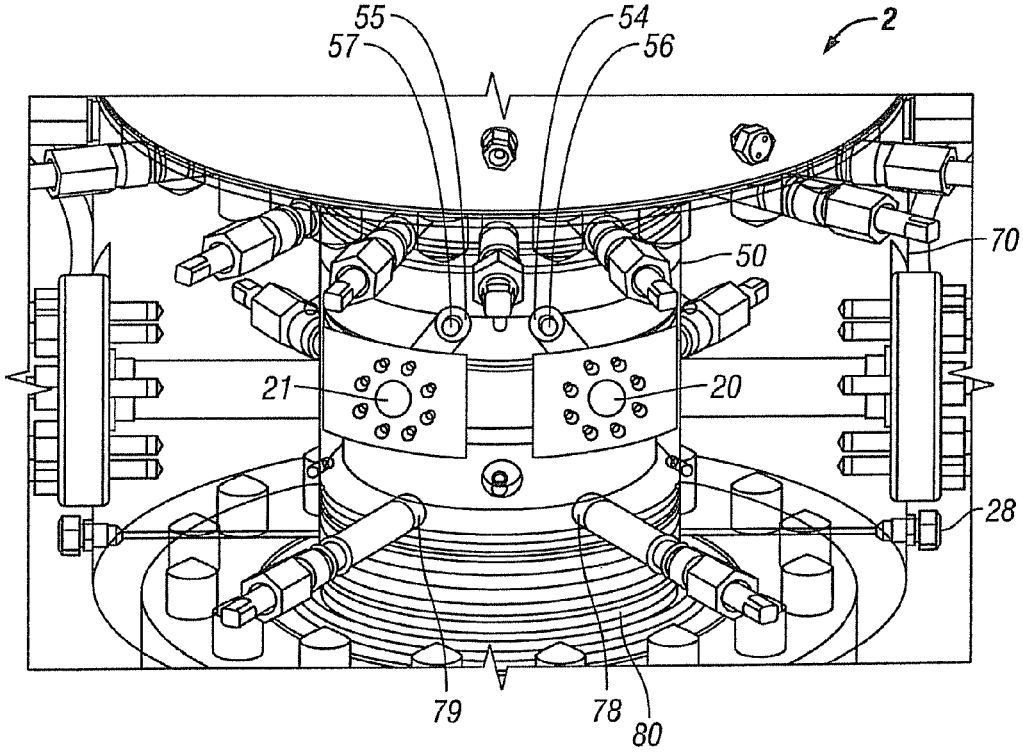
FIG. 5 is a partial cross-sectional schematic diagram of the wellhead system showing the hanger internal to the wellhead and the hydraulic side ports aligned with the access openings in the wellhead.
Figure 5A:
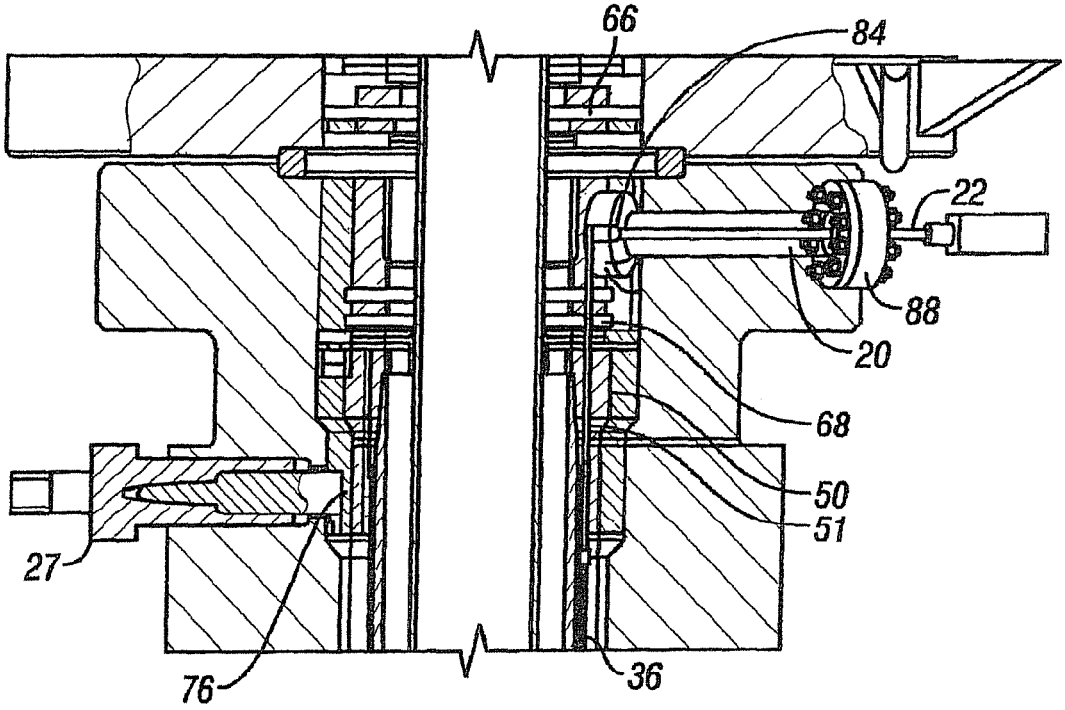
FIG. 5A is a cross-sectional schematic diagram illustrating isolation seals above and below the hydraulic side ports.

FIG. 5 is a partial cross-sectional schematic diagram of the wellhead system showing the hanger internal to the wellhead and the hydraulic side ports aligned with the access openings in the wellhead. FIG. 5A is a cross-sectional schematic diagram illustrating isolation seals above and below the hydraulic side ports. The figures will be described in conjunction with each other and illustrate the access openings without a flange, described below, that provide access to one or more side ports of the hanger 50. The wellhead system 2 generally includes the hanger 50 set into position in the drilling wellhead 70. The hanger 50 is aligned with the drilling wellhead 70, so that the ports 54, 55 are aligned with the openings 20, 21. This embodiment illustrates two openings 20, 21 that can be aligned with two side ports 54, 55. The number of openings can vary. For example, the system can include one side port and one access opening, one access opening and multiple side ports that are accessed through the one access opening, or a plurality of access openings aligned with a plurality of side ports, such as shown.

As described herein, during the initial phase where the hanger 50 is installed over the support packoff 80 in the drilling wellhead 70, the ports 54, 55 can be protected with plugs 56, 57 inserted therein to keep contaminants from entering the hydraulic passageways. When aligned with the openings 20, 21, the protective plugs 56, 57 can be manually removed from the side ports 54, 55 to open the hydraulic passageways and prepare for inserting and coupling the hydraulic lines thereto. One or more isolation seals 66, 68, shown in FIG. 5A, can seal the annulus region of the wellhead above and below the hydraulic side ports. The isolation can allow the access openings to be accessed even when the bore is under pressure.

A further safety feature can include a test port 28 that can be disposed on the downstream portion of the support packoff from the well-bore. Thus, if there is a leak above the support packoff, an operator can be warned prior to opening the access openings 20, 21.

Figure 6:
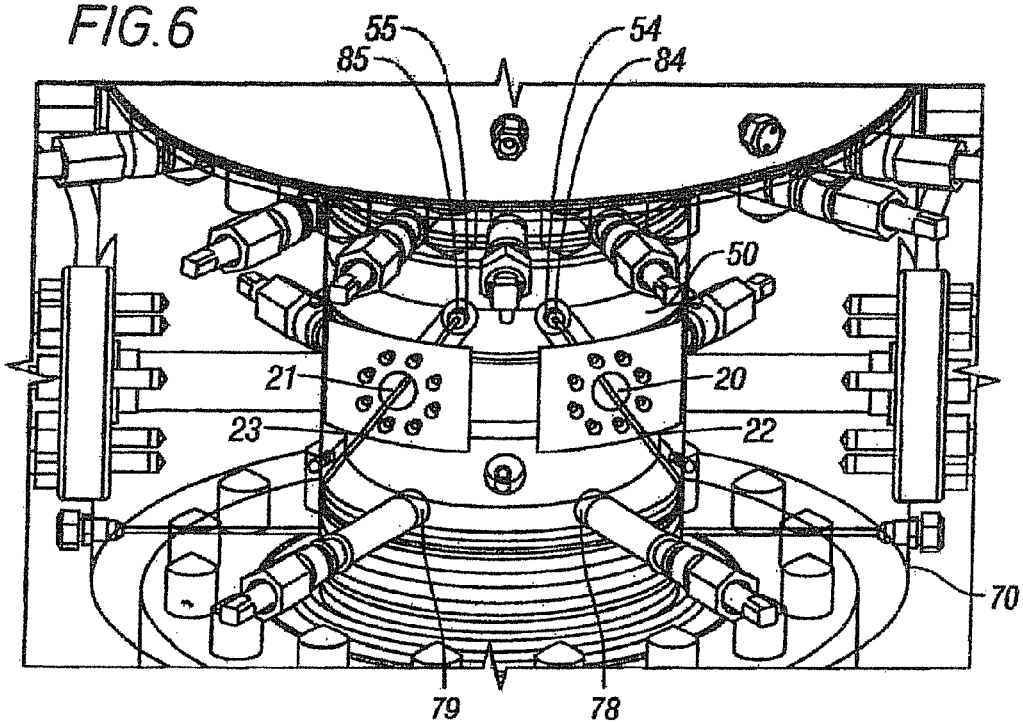
FIG. 6 is a partial cross-sectional schematic diagram of the wellhead system showing the hydraulic lines directly coupled through the access openings to the hydraulic side ports of the hanger.

FIG. 6 is a partial cross-sectional schematic diagram of the wellhead system showing the hydraulic lines directly coupled through the access openings to the hydraulic side ports of the hanger. With the side ports 54, 55 aligned with the openings 20, 21, the one or more hydraulic lines 22, 23 can be inserted through the openings 20, 21 and be directly connected with the side ports 54, 55. The coupling of the hydraulic lines 22, 23 can be made with the connectors 84, 85, respectively. The connectors 84, 85 can include suitable hydraulic line connectors such as flared couplings and other connectors, fittings, or even valves for the pressurized hydraulic applications.

Thus, the integrity of the hydraulic system is maintained during the installation of the hanger 50 in the drilling wellhead 70. The hydraulic side ports are only exposed to ambient conditions when the hanger is seated in position and a direct connection to the hydraulic port can be made.

Figure 7:
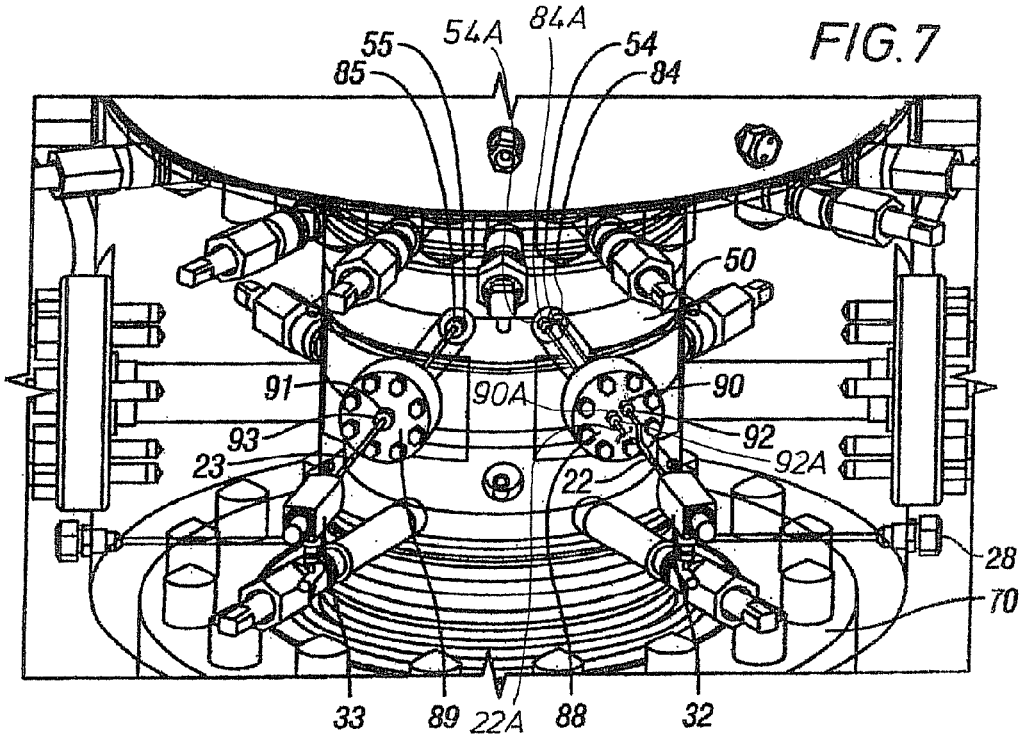
FIG. 7 is a partial cross-sectional schematic diagram of the wellhead system showing the hydraulic lines directly coupled to the side ports through sealed connectors.

FIG. 7 is a partial cross-sectional schematic diagram of the wellhead system showing the hydraulic lines directly coupled to the side ports through sealed connectors. The openings 20, 21 are generally sealed with flanges 88, 89, respectively. The flanges can provide the strength and integrity to the system for the large pressures and conditions that can be encountered in drilling the well-bore. The flanges 88, 89 can be machined, so that a metallic seal is formed between the openings 20, 21 of the head 70 and the flanges. The flanges 88, 89 can have one or more flange openings 90, 91 formed therethrough. The openings 90, 91 allow the hydraulic lines 22, 23 to protrude through the flanges. In some embodiments, the hydraulic line passing through the openings 90, 91 can be continuous without break for connections. In other embodiments, there can be an intermediate connection, such as at the flange. Generally, the openings 90, 91 would be sealed, so that pressure within the wellhead does not escape through the flanges 88, 89. Thus, flange connectors 92, 93 can be inserted over the hydraulic lines 22, 23 and engage the openings 90, 91 to form a seal between the openings and the hydraulic lines. FIG. 7 also shows one embodiment of a plurality of hydraulic lines positioned in an access opening, such as access opening 20. Hydraulic line 22A is positioned in the same access opening 20 as hydraulic line 22. Hydraulic line 22A may be inserted through opening 90A in flange 88 for direct connection with side port 54A in hanger 50. Flange connector 92A can be inserted over the line 22A to engage the opening 90A to form a seal between the opening 90A and the line 22A. The coupling of line 22A with hanger side port 54A may be made with connector 84A.

Further assembly of the hydraulic system can be performed. For example, one or more control valves 32, 33 can be coupled to the hydraulic lines 22, 23. The control valves can then be coupled to additional hydraulic lines that can couple to various control mechanisms, such as the surface control unit 34 described in reference to FIG. 1.

Advantageously, an additional safety feature can be an indicator on the head indicating an open and close control of the downhole hydraulic tool. For example, the flange 88 could be colored green through which the hydraulic line 22 passes that can be used to open the downhole hydraulic tool. The flange 89 could be colored red through which the hydraulic line 23 passes that can be used to close the downhole hydraulic tool.

The various methods and embodiments of the invention can be included in combination with each other to produce variations of the disclosed methods and embodiments, as would be understood by those with ordinary skill in the art, given the understanding provided herein. Also, various aspects of the embodiments could be used in conjunction with each other to accomplish the understood goals of the invention. Also, the directions such as "top," "bottom," "left," "right," "upper," "lower," and other directions and orientations are described herein for clarity in reference to the figures and are not to be limiting of the actual device or system or use of the device or system. The term "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally. Unless the context requires otherwise, the word "comprise" or variations such as "comprises" or "comprising", should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. Further, the order of steps can occur in a variety of sequences unless otherwise specifically limited. The various steps described herein can be combined with other steps, interlineated with the stated steps, and/or split into multiple steps. Additionally, the headings herein are for the convenience of the reader and are not intended to limit the scope of the invention.

The invention has been described in the context of various embodiments and not every embodiment of the invention has been described. Apparent modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect all such modifications and improvements to the full extent that such falls within the scope or range of equivalents of the following claims.

Further, any references mentioned in the application for this patent as well as all references listed in the information disclosure originally filed with the application are hereby incorporated by reference in their entirety to the extent such may be deemed essential to support the enabling of the invention. However, to the extent statements might be considered inconsistent with the patenting of the invention, such statements are expressly not meant to be considered as made by the Applicant(s).

I claim:

1. A wellhead system for use with a downhole hydraulic tool to control well-bore pressure, comprising:

a hanger having a hanger hydraulic tool port adapted to be coupled to the downhole hydraulic tool and a hanger hydraulic side port in fluid communication with said hanger hydraulic tool port;

a wellhead adapted to support said hanger;

an access opening formed through said wellhead, said hanger hydraulic side port alignable with said wellhead access opening;

a seal between said hanger and said wellhead configured to seal said access opening from the well-bore pressure; and a wellhead hydraulic line extending in said access opening and connectable with said hanger hydraulic side port when said hanger hydraulic side port is aligned with said wellhead access opening.

2. The system of claim 1, further comprising an annulus region above and below said hanger hydraulic side port, wherein said seal between said hanger and said wellhead, comprising:

a first annular seal above said wellhead access opening and a second annular seal below said wellhead access opening to seal said annulus region.

3. The system of claim 2, further comprising:

a sealing member adapted to form a seal with the access opening, the sealing member having a sealable opening through which said wellhead hydraulic line may extend.

4. A method for providing hydraulic fluid to a hydraulically operated downhole tool to be used in a well-bore, comprising the steps of:

positioning a wellhead with the well-bore, said wellhead having an access opening;

positioning a hanger with said wellhead, said hanger having a hanger side port and a hanger tool port, said hanger side port and said hanger tool port being in fluid communication;

aligning said hanger side port with said wellhead access opening to seal said wellhead access opening from the well-bore;

sealing said hanger with said wellhead; and extending a wellhead hydraulic line in said access opening to connect with said hanger.

5. The method of claim 4, further comprising the steps of:

connecting one end of said wellhead hydraulic line with said hanger side port; and sealing said wellhead access opening while allowing said wellhead hydraulic line to extend in said wellhead access opening for providing the hydraulic fluid.

6. A wellhead system for use with a downhole hydraulic tool, comprising:

a hanger having a hydraulic tool port adapted to be coupled to the downhole tool, and a hydraulic side port in the hanger in fluid communication with the hanger tool port;

a wellhead hydraulic line;

a wellhead adapted to support the hanger;

an access opening formed through the wellhead, said hanger hydraulic side port alignable with said wellhead access opening;

a first sealing member threadedly received with the access opening and adapted to form a seal with the access opening, said sealing member having a sealable opening through which said wellhead hydraulic line may extend, said wellhead hydraulic line is connectable with the hanger hydraulic side port when the hanger side port is aligned with the wellhead access opening; and a first annular seal above said access opening and a second annular seal below said access opening configured to seal between said hanger and the wellhead.

7. The system of claim 6, further comprising a tool hydraulic line coupled between the downhole tool and the hydraulic tool port.

8. The system of claim 6, wherein said wellhead hydraulic line is sealed in the first sealing member sealable opening.

9. The system of claim 6, further comprising a plurality of wellhead hydraulic lines and a plurality of hanger side ports.

10. The system of claim 9, further comprising a second sealing member and a second access opening in the wellhead, wherein each of said plurality of hanger side ports are simultaneously alignable with one of said access openings.

11. The system of claim 6, further comprising an indicator on the first sealing member configured to verify a hydraulic connection of the wellhead hydraulic line.

12. The system of claim 6, further comprising a pressure test port in the wellhead to indicate whether the access opening is pressurized.

13. The system of claim 6, wherein said first sealing member seals against internal pressures in the wellhead that may exceed 10,000 PSI.

14. The system of claim 6, further comprising the hanger having a reduced portion, wherein the hanger side port is disposed in said reduced portion of said hanger.

15. The system of claim 6, wherein said first annular seal and second annular seal are non-metal.

16. The system of claim 6, wherein the wellhead is a unitized drilling wellhead that comprises a casing head and casing spool installed as a single unit.

17. The system of claim 6, wherein the wellhead is sized to receive a plurality of hangers.

18. The system of claim 6, wherein the downhole tool comprises a downhole deployment valve.

19. A method for providing hydraulic fluid to a hydraulically operated downhole tool to be used in a well-bore, comprising the steps of:

positioning a wellhead with the well-bore, said wellhead having an access opening;

coupling the hydraulically operated tool with a tubular;

coupling said tubular with a hanger, said hanger having a hanger side port and a hanger tool port, said hanger side port and said hanger tool port being in fluid communication;

connecting a tool hydraulic line from the hydraulically operated tool to said hanger tool port;

aligning said hanger side port with said wellhead access opening while simultaneously aligning a first annular seal above said wellhead access opening and aligning a second annular seal below said wellhead access opening;

sealing said hanger with said wellhead with said first annular seal; and sealing said hanger with said wellhead with said second annular seal, wherein said wellhead access opening being sealed from the well-bore after the steps of sealing said hanger with said first annular seal and said second annular seal.

20. The method of claim 19, further comprising the step of:

sealing said wellhead access opening with an annulus region defined by said first annular seal, said second annular seal, said hanger and said wellhead.

* * * * *